US006929078B1

(12) United States Patent
Randall

(10) Patent No.: US 6,929,078 B1
(45) Date of Patent: Aug. 16, 2005

(54) APPARATUS FOR USE IN ENLARGING A BOREHOLE

(75) Inventor: Guy P. Randall, Wooster, OH (US)

(73) Assignee: Astec Industries, Inc., Chattanooga, TN (US)

( * ) Notice: Subject to any disclaimer, the term of this patent is extended or adjusted under 35 U.S.C. 154(b) by 24 days.

(21) Appl. No.: 10/300,535

(22) Filed: Nov. 21, 2002

(51) Int. Cl.[7] ..... E21B 10/26
(52) U.S. Cl. ..... 175/406
(58) Field of Search ..... 175/53, 406, 385, 175/391–394, 400, 396

(56) References Cited

U.S. PATENT DOCUMENTS 975,163 A * 11/1910 Rogers ..... 175/388
D254,134 S 2/1980 Sheldon
4,193,461 A 3/1980 Lamberton et al.
4,364,441 A 12/1982 Geeting
4,618,010 A 10/1986 Falgout, Sr. et al.
4,901,800 A 2/1990 Wilson
5,641,027 A 6/1997 Foster
5,687,807 A * 11/1997 Woods et al. ..... 175/393
5,794,727 A 8/1998 Murray
5,921,331 A * 7/1999 Randall ..... 175/394
5,967,689 A * 10/1999 Fleischauer ..... 175/391
5,992,548 A 11/1999 Silva et al.
6,161,625 A 12/2000 Mati
6,250,403 B1 6/2001 Beckwith
6,352,122 B1 3/2002 Love

* cited by examiner

*Primary Examiner*—Kenneth Thompson
(74) *Attorney, Agent, or Firm*—Chambliss, Bahner & Stophel, P.C.

(57) ABSTRACT

A device for enlarging a bore includes an elongate body having a forward end, a rear end and an axis of rotation. The body of the device is adapted to be moved through the bore while being rotated about its axis. The device also includes a cutting blade which is attached to the body at or near its forward end, and a plurality of mixing wings. Each of the mixing wings has a unique shape, and each is attached to the body behind the cutting blade so that the axis of rotation of the body is within the plane spanned by the mixing wing.

21 Claims, 10 Drawing Sheets

APPARATUS FOR USE IN ENLARGING A BOREHOLE

FIELD OF THE INVENTION

This invention relates generally to a device for use in enlarging a bore that has been cut in the ground, and more particularly to a device for use as a backreamer in connection with the directional drilling of a borehole. The invention has particular application to the construction of a borehole through ground containing clay or sand for the purpose of installing utility lines, pipelines and the like.

BACKGROUND AND DESCRIPTION OF THE PRIOR ART

Many utility lines, pipelines and other underground components are installed in or under the ground by boring a borehole in a generally-horizontal direction in the ground rather than by digging a trench. This type of construction, which is sometimes referred to as "horizontal boring" or "directional drilling", eliminates the need to excavate earth in order to install an underground component, and thereby saves several steps in the installation process. If no trench is dug, there will be no trench to fill, and no disturbed surface to reclaim.

Directional drilling is generally carried out using a boring machine that includes a drill string made of a series of connected pipe sections with a cutting head at the distal end thereof. The machine is operated to cause the cutting head to cut into the ground to drill a pilot bore along a planned path underground. Typically, the planned path is generally arcuate in shape from the entry point at the surface of the ground, continuing underneath a roadway, river or other obstacle, to the exit point at the surface on the other side of the obstacle. Sufficient lengths of pipe are added to the drill string as needed to reach the exit point where the cutting head emerges from the earth. When the pilot bore is complete, it may be enlarged by replacing the cutting head with an enlarging device, commonly known as a backreamer. The backreamer is connected to the distal end of the drill string and moved through the pilot bore towards the boring machine, either with or without rotation of the drill string. The backreamer expands and stabilizes the walls of the bore, generally while pulling a utility line or other underground component through the enlarged bore behind it.

Various types of backreamers are conventionally used. Some conventional backreamers are conical in shape and are particularly suited for compressing compactible soils into the wall of the bore. Such backreamers may be pulled without rotation through the pilot bore, although pulling them through the pilot bore while rotating them is more common. Other conventional backreamers include helical threads or other cutting mechanisms that are rotated while the backreamer is pulled through the bore. Frequently, drilling fluid is injected into the pilot bore during backreaming to assist in the creation of a slurry with the cuttings or other excess material that is to be removed from the pilot bore in the backreaming process. On some occasions when fluid is injected in connection with a use of a cone-shaped backreamer, soil compressibility and other conditions will be insufficient to create a slurry that is efficient in removing cuttings or other material from the pilot bore, and the backreamer will get stuck in the bore. However, the use of drilling fluid in connection with a threaded or other type of cutting backreamer generally creates a slurry of the fluid and the cuttings of the backreamer, which slurry can often be removed from the bore as the backreamer progresses towards the boring machine.

Most conventional backreamers are quite massive and require considerable energy to pull them through (and if required, to rotate them in) the pilot bore. Nevertheless, many conventional backreamers readily become bogged down in soils containing clay, sand or other dense material. A particular problem when boring through clay is the tendency of the clay to stick to the components of the backreamer, thus adding to its mass and decreasing its effectiveness in enlarging the bore. A rotatable backreamer that is reportedly less massive than typical is described in U.S. Pat. No. 6,250,403 of Beckwith. The Beckwith backreamer includes an elongate, hollow body, a plurality of cutting elements, and a plurality of blades that are mounted on the body in such a way that the plane of each blade intersects the axis of the body and the plane of at least one other blade. In the preferred embodiment, the blade nearest the cutting elements is angled such that its leading edge enlarges the bore and two blades mounted behind the first blade are angled to stabilize the device in the bore hole and chum the cuttings produced by the first blade. Fluid jets are positioned adjacent to the cutting elements and blades to direct fluid at these elements to clean them. Although the Beckwith device has reportedly performed very well, it is believed that improved results may be obtained with a device having a different configuration.

ADVANTAGES OF A PREFERRED EMBODIMENT OF THE INVENTION

Among the advantages of a preferred embodiment of the invention is that it provides a device for enlarging a bore that has a structure that minimizes the sticking of clay or sticky soil on its surfaces. Still another advantage of a preferred embodiment of the invention is that it may facilitate the production of an enlarged bore having stable walls that will increase the ease with which a utility line or other underground component may be pulled through the bore. Yet another advantage of a preferred embodiment of the invention is that it provides an enlarging device that may be readily re-oriented within the bore for further advancement, if it becomes necessary to stop or reverse the progress of the enlarging device through the bore.

Additional objects and advantages of this invention will become apparent from an examination of the drawings and the ensuing description.

EXPLANATION OF TECHNICAL TERMS

As used herein, the term "forward" refers to the direction in which the device for enlarging a bore is moved in a pilot bore as it enlarges the bore. Consequently, the forward end of the elongate body of the device is the end that first encounters the unenlarged pilot bore as the device is moved to enlarge the pilot bore.

As used herein, the "rear end" of the elongate body of the device is the end opposite the forward end.

As used herein, "movement of the axis of rotation of the body with respect to the centerline of the bore" means that the axis of rotation of the body will not coincide with the centerline of the bore as the body is rotated and the device is moved through the bore.

As used herein, the term "unique shape", when applied to a mixing wing of the invention, means that such mixing wing has a shape that is different from the shape of each of the other mixing wings.

As used herein, the term "unique mass", when applied to a mixing wing of the invention, means that such mixing wing has a mass that is different from the mass of each of the other mixing wings.

As used herein, "the area spanned by a mixing wing" of the invention comprises the area bounded by the outermost extent of the mixing wing (as measured from the elongate body) from the intersection of the leading edge of the mixing wing with the elongate body to the intersection of the trailing edge of the mixing wing with the elongate body (or to a line drawn from the most rearward point on the trailing edge to the elongate body that is perpendicular to the axis of rotation of the elongate body).

As used herein, "the area occupied by a mixing wing" of the invention comprises the area bounded by the peripheral edges or sides of the mixing wing. If the mixing wing is formed by a band that is attached at one or more points to the body of the device, the area occupied by the mixing wing is the area of the band.

As used herein, the term "unique surface area", when applied to a mixing wing of the invention, means that the area occupied by such mixing wing is different from the area occupied by each of the other mixing wings.

As used herein, the term "the plane spanned by the mixing wing" means the plane spanned by or co-planar with the major portion of the mixing wing.

SUMMARY OF THE INVENTION

The invention comprises a device for enlarging a bore. The device includes an elongate body having a forward end, a rear end and an axis of rotation, which body is adapted to be moved through the bore while being rotated about its axis. The device also includes a cutting blade which is attached to the body at or near its forward end, and a plurality of mixing wings. Each of the mixing wings has a unique shape, and each is attached to the body behind the cutting blade so that the axis of rotation of the body is within the plane spanned by the mixing wing.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within, the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
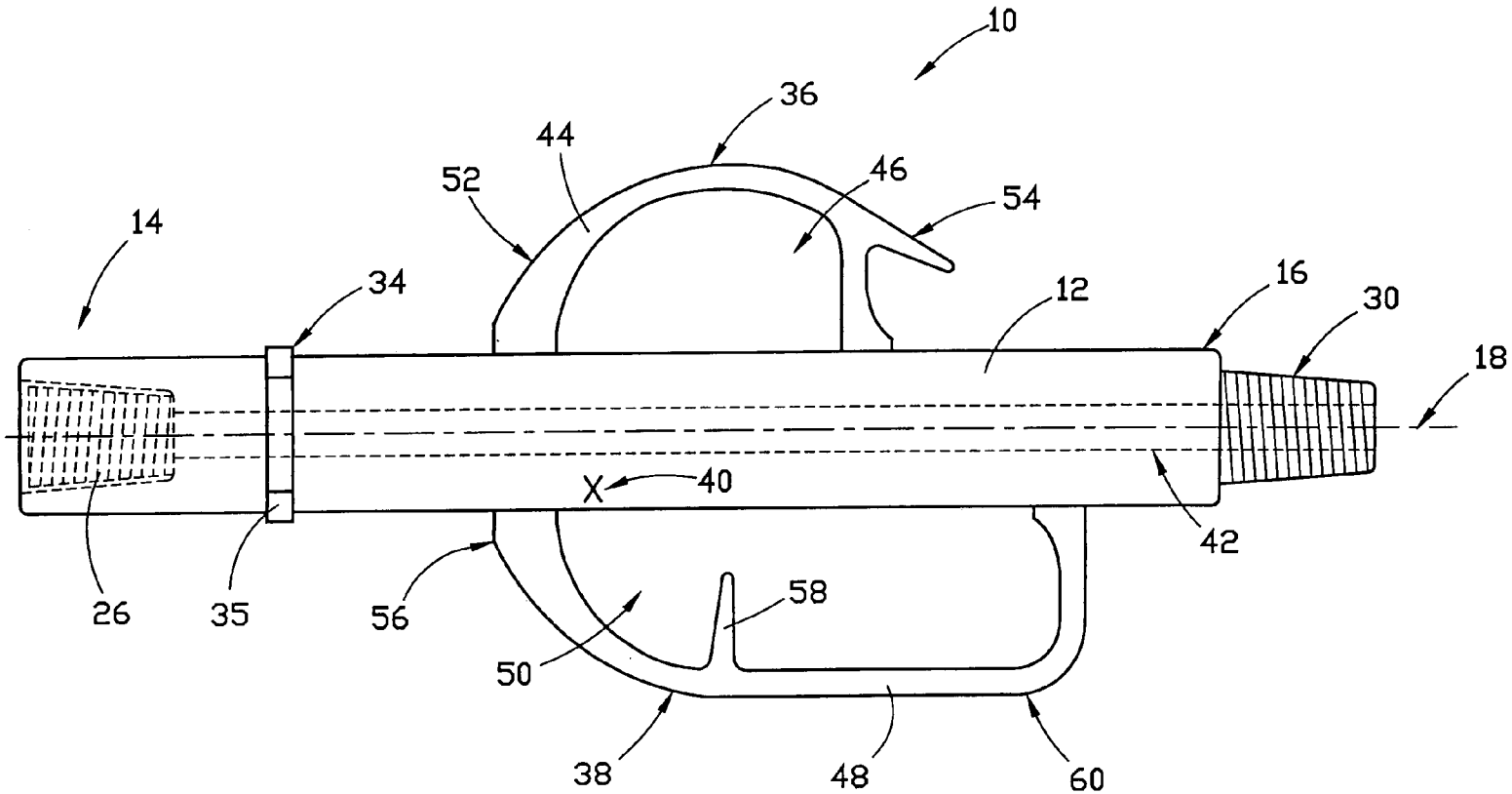
FIG. 1 is a side view of a first embodiment of the invention.
Figure 2:
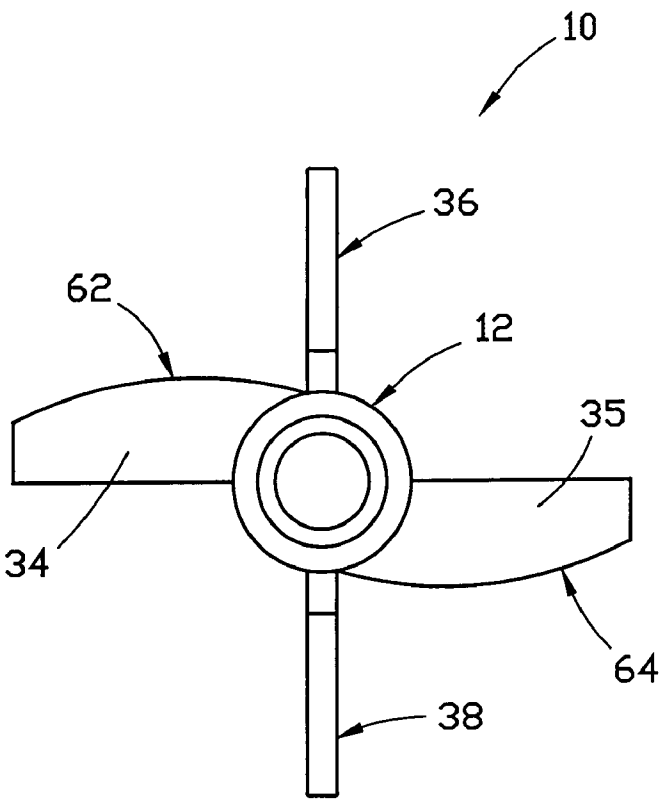
FIG. 2 is a front view of the embodiment of the invention illustrated in FIG. 1.
Figure 3:
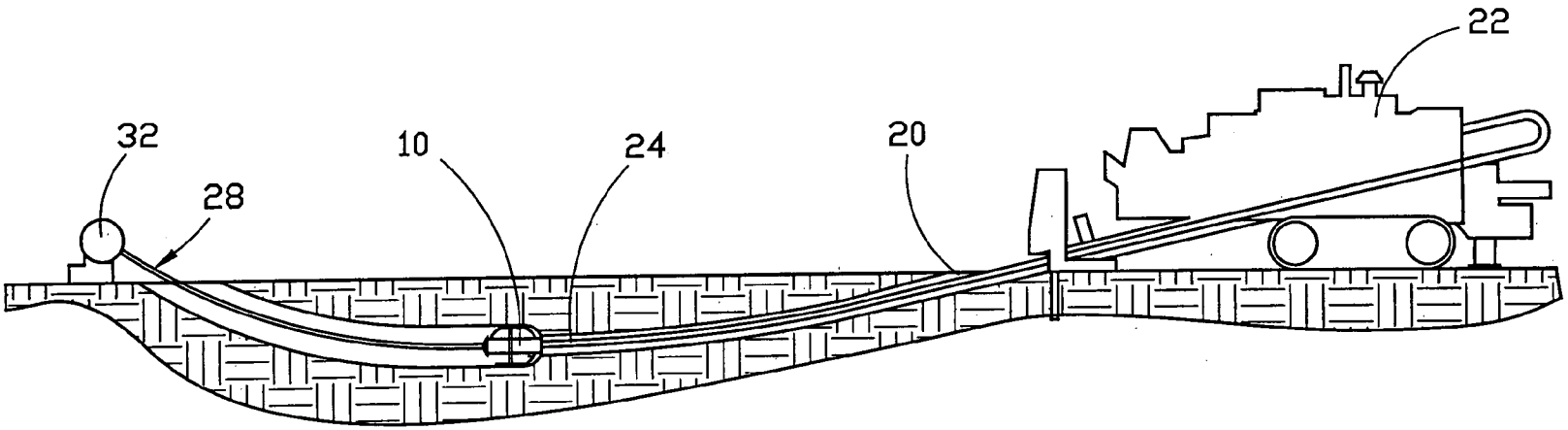
FIG. 3 is a side elevation view of a directional drilling machine and the invention showing a use of the invention in connection with the operation of a directional drilling machine.

Referring now to the drawings, a first embodiment 10 of the invention, which is adapted for enlarging a bore, is shown in FIGS. 1 and 2. Device 10 includes elongate body 12 having a forward end 14, a rear end 16, and axis of rotation 18. A use of device 10 to enlarge a pilot bore is illustrated in FIG. 3. As shown therein, pilot bore 20 has been cut by directional drill 22 employing a string of drill pipe 24 and a cutting head (not shown) which has been subsequently replaced with enlarging device 10. Preferably, the distal end of the drill string is attached to forward end 14 of the body of device 10 by engagement with internal threads 26, and directional drill 22 is then employed to pull the device through the bore while rotating it about axis 18. Device 10 expands and stabilizes the walls of the bore, while pulling lead line 28 for a utility line or another type of underground component, which line is preferably attached to body 12, or to a conventional swivel with a coupler (not shown in FIGS. 1–3) which is attached to body 12, by engagement with external threads 30, from reel 32 (or while pulling the utility line or other component itself) through the enlarged bore behind it.

Referring again to FIGS. 1 and 2, device 10 includes a cutting blade, and more preferably a pair of cutting blades 34 and 35 which are attached to the body at or near its forward end. Device 10 also includes a plurality of mixing wings, preferably a pair of mixing wings, such as mixing wings 36 and 38. Each of the mixing wings has a unique shape. In addition, each of the mixing wings is attached to the body behind the cutting blade so that the axis of rotation of the body is within the plane spanned by the mixing wing. Although not shown in the drawings, such configuration of the mixing wings may include an edge or minor portion of one or more of the mixing wings that is bent or curved out of the plane spanned by the major portion of such mixing wing. Preferably, the mixing wings are configured and/or located so that the center of mass of the device, shown at 40 in FIG. 1, is not on axis 18, the axis of rotation of the body. Furthermore, it is also preferred that device 10 include a pair of mixing wings that are located on generally opposite sides of the elongate body.

It is also preferred that the elongate body 12 include a passage 42 for drilling fluid and a plurality of orifices in fluid communication with the passage (not shown in FIG. 1) through which drilling fluid may be dispensed from the body. This drilling fluid lubricates the bore and creates a slurry with the cuttings from the cutting blade or blades of the device. The mixing wings of the device reduce and blend the cuttings in the slurry so that the slurry can be more easily removed from the bore as drilling fluid is continuously pumped therethrough. It is preferred that the mixing wings be located far enough back along the body from the blade or blades that the clay or other soil cuttings cannot easily span the distance between the blades and the mixing wings as a unitized mass that can be supported by the wings. The cuttings are therefore more easily sheared into smaller particle sizes by the mixing wings to facilitate their incorporation into the slurry.

Referring again to FIG. 3, bore 20 has a centerline (not shown for clarity, although it may be generally approximated as extending through the center of drill string 24). By providing mixing wings which each have a unique shape, the axis of rotation of the body will most likely move with respect to the centerline as the body is rotated and moved through the bore. By locating the center of mass of the device off of the axis of rotation (as is preferred), device 10 will tend to wobble as it is rotated and pulled through the bore. Wobbling action will also be induced if the device includes a pair of mixing wings that are located on generally opposite sides of the elongate body, because the wings will be unsupported by the walls of the bore when the wings are at the 3:00 and 9:00 positions. This wobbling action helps to prevent the cuttings from adhering to the wings and the body and helps to increase the reduction and blending of the cuttings in the slurry.

Preferably, each of the mixing wings is formed by a band that is attached to the body behind the cutting blade or blades. Such a mixing wing will include (or surround) an open area within the area spanned by the wing, and it is preferred that the area occupied by the wing (i.e., the area spanned by the wing less the open area) comprises no more than about 40%, and most preferably no more than about 20–30%, of the area spanned by such wing. It is also preferred that the area occupied by the wing comprises no more than about 15%, and most preferably no more than about 9–11%, of the cross-sectional area of the enlarged bore. Thus, mixing wing 36 of enlarging device 10 is formed by band 44 and includes or surrounds open area 46. Similarly, mixing wing 38 is formed by band 48 and includes or surrounds open area 50. It is also preferred that each of the mixing wings has a unique mass and a unique surface area.

Preferably, each mixing wing includes a leading edge that is swept back for engaging the cuttings at a gradually increasing distance from the body in a configuration that is generally convex. It is also preferred that the leading edge of each mixing wing be substantially identical in configuration to that of each of the other mixing wings. Furthermore, it is preferred that at least one of the mixing wings includes an internal finger, and that at least one of the mixing wings includes a trailing edge that is curved towards the body. Finally, it is preferred that none of the mixing wings includes a trailing edge that is curved away from the body. By providing the mixing wings in this preferred configuration, it is believed that the mixing wings will more efficiently cut and blend the cuttings into a slurry with the drilling fluid. It is also believed that an enlarging device having mixing wings of the preferred configuration may be readily re-oriented within the bore for further advancement, if it becomes necessary to stop or reverse the progress of the enlarging device through the bore. This preferred configuration of the mixing wings is illustrated in FIG. 1, wherein mixing wing 36 includes leading edge 52 (that is swept back in a gradually increasing distance from the body in a generally convex configuration) and trailing edge 54 (that is curved towards body 12), and mixing wing 38 includes leading edge 56 (which is substantially identical to leading edge 52 of wing 36), internal finger 58 and trailing edge 60.

Referring now to FIG. 2, it can be seen that a preferred embodiment of the invention includes a pair of cutting blades 34 and 35, each of which is provided with a curved leading edge, which are located on generally opposite sides of elongate body 12. Thus, blade 34 is provided with curved leading edge 62, and blade 35 is provided with curved leading edge 64. It is also preferred that the blades be configured with minimal surface area and mass. Also, as shown in FIG. 2, when the device is provided with a pair of blades and a pair of mixing wings, the blades should be oriented at a different angular position (clock position) relative to the axis of rotation of the body (which is perpendicular to the view of FIG. 2) than the mixing wings. Thus, device 10 includes blades 34 and 35, which are oriented generally at the 9:00 and 3:00 positions respectively, relative to the axis of rotation of the body, and mixing wings 36 and 38, which are oriented generally at the 12:00 and 6:00 positions respectively.

Figure 4:
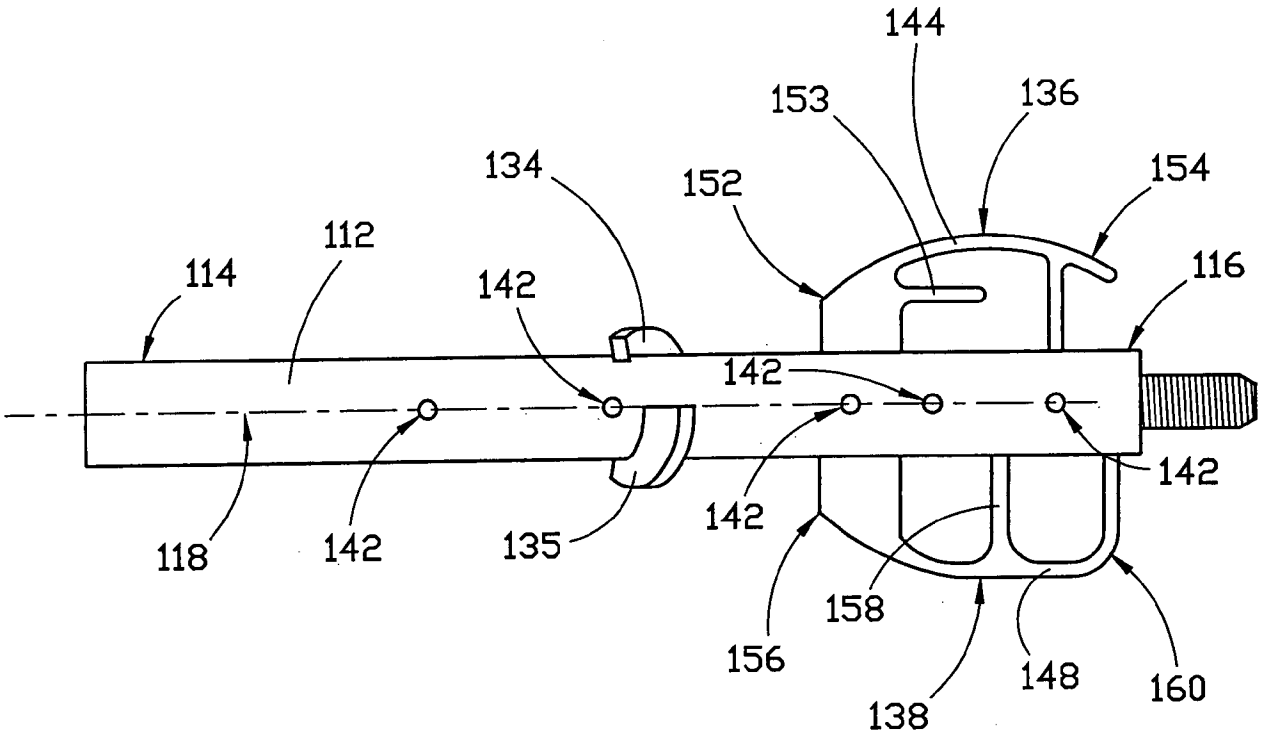
FIG. 4 is a side view of a second embodiment of the invention.
Figure 5:
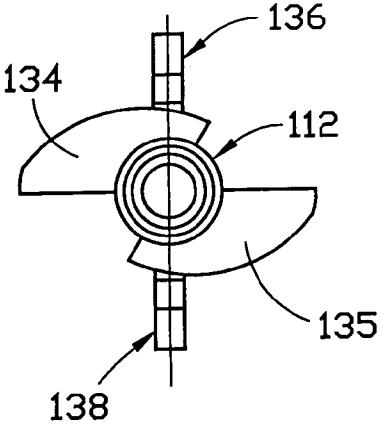
FIG. 5 is a front view of the embodiment of the invention illustrated in FIG. 4.

Another embodiment of the invention is illustrated in FIGS. 4 and 5. As shown therein, device 110 includes elongate body 112 having a forward end 114, a rear end 116, and axis of rotation 118. Device 110 also includes a pair of cutting blades 134 and 135 which are attached to the body at or near its forward end, and a pair of mixing wings 136 and 138. Each of the mixing wings has a unique shape, and each is attached to the body behind the cutting blade so that the axis of rotation of the body is within the plane spanned by the mixing wing. Preferably, the mixing wings are configured and located so that the center of mass of the device (not shown) is not on axis 118, the axis of rotation of the body. Elongate body 112 includes a passage for drilling fluid (not shown) and a plurality of orifices 142 that are in fluid communication with the passage through which drilling fluid may be dispensed from the body. Preferably, orifices 142 are arranged and configured so that drilling fluid passing through the passage is directed through the orifices in a direction that is generally perpendicular to axis 118.

Preferably, each of the mixing wings of device 110 has a unique mass and a unique surface area. It is also preferred that each of the mixing wings is formed by a band that is attached to the body behind the cutting blade or blades. Thus, mixing wing 136 of enlarging device 110 is formed by band 144, and mixing wing 138 is formed by band 148. Mixing wing 136 includes leading edge 152) that is swept back in a gradually increasing distance from the body in a generally convex configuration), internal finger 153, and trailing edge 154 that is curved towards body 112. Mixing wing 138 includes leading edge 156 (which is substantially identical to leading edge 152 of wing 136), internal finger 158 and trailing edge 160. It should be noted that each of mixing wings 136 and 138 is provided with an internal finger (153 and 158, respectively) that is unique. Good results may be obtained when an enlarging device is provided with two mixing wings having such features in which each of the internal fingers, such as fingers 153 and 158, is generally perpendicular to the other.

Referring now to FIG. 5, it can be seen that the cutting blades 134 and 135 of device 110 are each provided with a curved leading edge. These cutting blades are located on generally opposite sides of elongate body 112 and are oriented at a different angular position (clock position) relative to the axis of rotation of the body (which is perpendicular to the view of FIG. 5) than the mixing wings. Unlike blades 34 and 35 of device 10, each of the cutting blades of device 110 is oriented at an angle of less than 90°, preferably at an angle of about 70°, with respect to the axis of rotation of body 112, as shown in FIG. 4.

Figure 6:
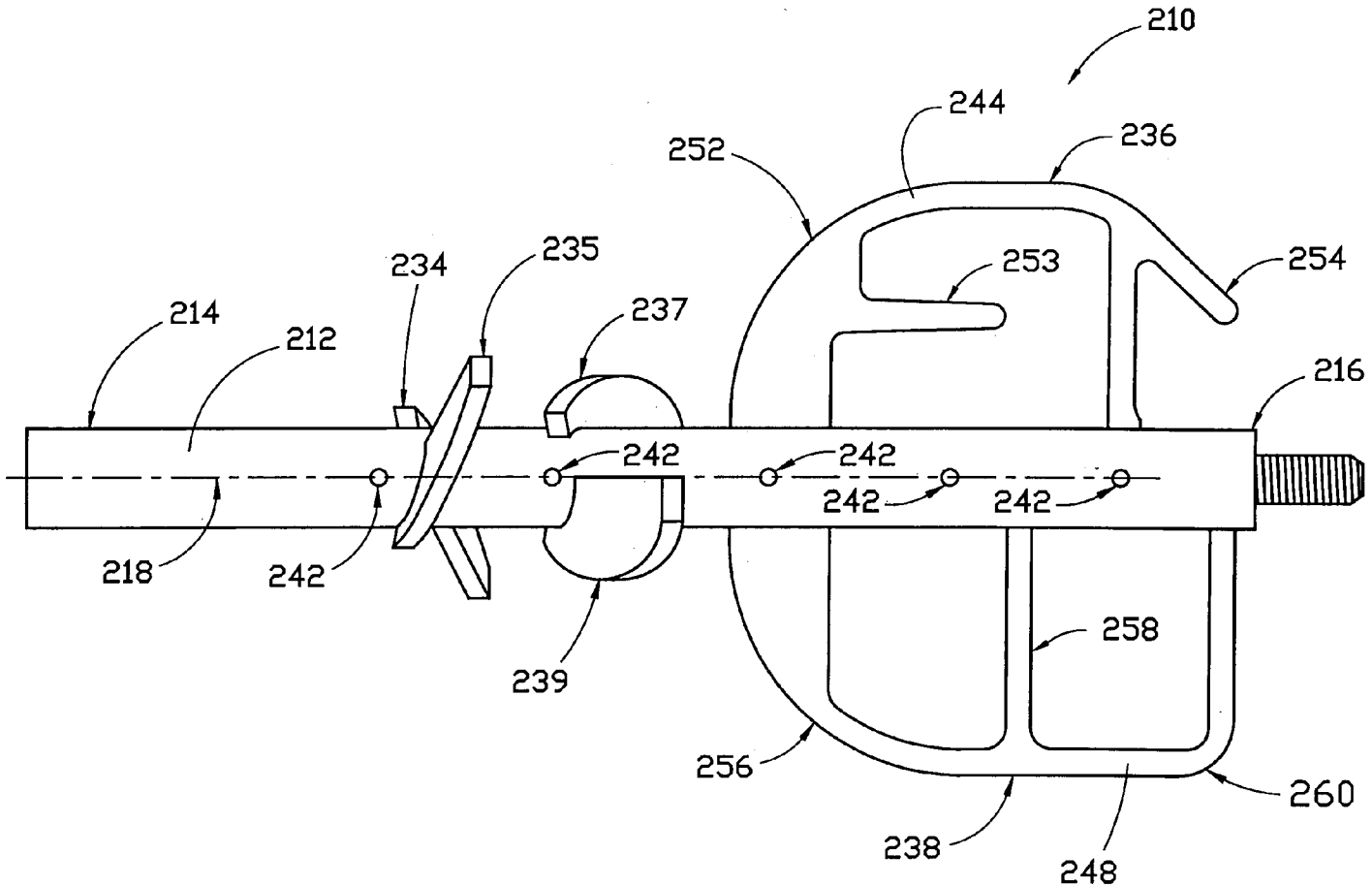
FIG. 6 is a side view of a third embodiment of the invention.
Figure 7:
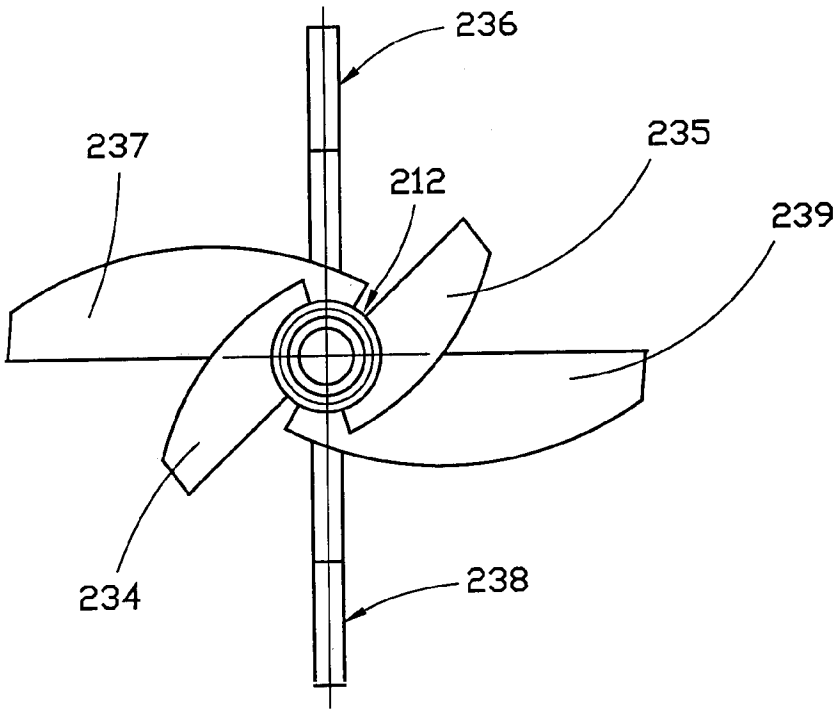
FIG. 7 is a front view of the embodiment of the invention illustrated in FIG. 6.

Still another embodiment of the invention is illustrated in FIGS. 6 and 7. As shown therein, device 210 includes elongate body 212 having a forward end 214, a rear end 216, and axis of rotation 218. Device 210 also includes a first pair of cutting blades 234 and 235, which are attached to the body at or near its forward end and located on generally opposite sides of body 212, and a second pair of cutting blades 237 and 239 that are located on generally opposite sides of the body behind the first pair of cutting blades.

Device 210 also includes a pair of mixing wings 236 and 238. Each of the mixing wings has a unique shape, and each is attached to the body behind the cutting blades so that the axis of rotation of the body is within the plane spanned by the mixing wing. Preferably, the mixing wings are configured and located so that the center of mass of the device (not shown) is not on axis 218, the axis of rotation of the body. Elongate body 212 includes a passage for drilling fluid (not shown) and a plurality of orifices 242 that are in fluid communication with the passage through which drilling fluid may be dispensed from the body. Preferably, orifices 242 are arranged and configured so that drilling fluid passing through the passage is directed through the orifices in a direction that is generally perpendicular to axis 218.

Preferably, each of the mixing wings of device 210 has a unique mass and a unique surface area. It is also preferred that each of the mixing wings is formed by a band that is attached to the body behind the cutting blade or blades. Thus, mixing wing 236 of enlarging device 210 is formed by band 244, and mixing wing 238 is formed by band 248. Mixing wing 236 includes leading edge 252 (that is swept back in a gradually increasing distance from the body in a generally convex configuration), internal finger 253, and trailing edge 254 that is curved towards body 212. Mixing wing 238 includes leading edge 256 (which is substantially identical to leading edge 252 of wing 236), internal finger 258 and trailing edge 260. Each of mixing wings 236 and 238 has a unique shape, in part because each of the internal fingers 253 and 258 is generally oriented perpendicular to the other.

Referring now to FIG. 7, it can be seen that the cutting blades 234, 235, 237 and 239 of device 210 are each provided with a curved leading edge. It can also be seen that the first pair of cutting blades 234 and 235 are located on generally opposite sides of elongate body 212 and are oriented at a different angular position (clock position) relative to the axis of rotation of the body (which is perpendicular to the view of FIG. 7) than the second pair of cutting blades, and at a different angular position than the mixing wings. In addition, the second pair of cutting blades 237 and 239 are located on generally opposite sides of elongate body 212 and are oriented at a different angular position (clock position) relative to the axis of rotation of the body than that of both the first pair of cutting blades and the mixing wings. Each of the cutting blades of device 210 is oriented at an angle of less than 90°, preferably at an angle of about 70°, with respect to the axis of rotation of body 212, as shown in FIG. 6.

Figure 8:
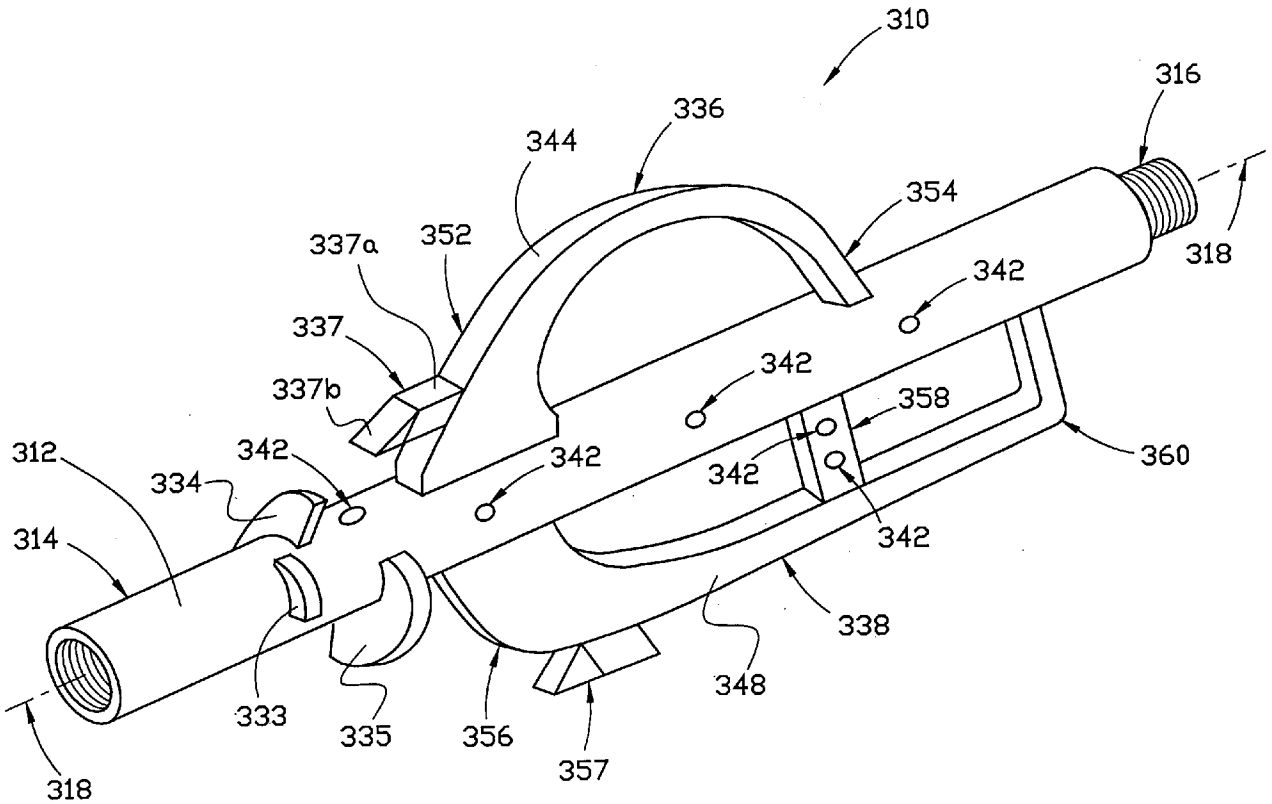
FIG. 8 is a perspective view of a fourth embodiment of the invention.

Yet another embodiment of the invention is illustrated in FIG. 8. As shown therein, device 310 includes elongate body 312 having a forward end 314, a rear end 316, and axis of rotation 318. Device 310 also includes a plurality of cutting blades 333, 334 and 335, which are attached to the body at or near its forward end. Device 310 also includes a pair of mixing wings 336 and 338, each of which has a unique shape. Each of mixing wings 336 and 338 is attached to the body behind the cutting blades so that the axis of rotation of the body is within the plane spanned by the mixing wing. Preferably, these mixing wings are configured and located so that the center of mass of the device (not shown) is not on axis 318, the axis of rotation of the body. Elongate body 312 includes a passage for drilling fluid (not shown) and a plurality of orifices 342 that are in fluid communication with the passage through which drilling fluid may be dispensed from the body. Preferably, orifices 342 are arranged and configured so that drilling fluid passing through the passage is directed through the orifices in a direction that is generally perpendicular to axis 318.

Preferably, each of the mixing wings of device 310 has a unique mass and a unique surface area. It is also preferred that each of the mixing wings is formed by a band that is attached to the body behind the cutting blade or blades. Thus, mixing wing 336 of enlarging device 310 is formed by band 344, and mixing wing 338 is formed by band 348. Mixing wing 336 includes leading edge 352 and trailing edge 354. A portion of the leading edge of mixing wing 336 is provided with a cutting surface in the form of cutter 337 (comprised of steel cutter body 337*a* with tungsten carbide insert 337*b* mounted thereon). Mixing wing 338 includes leading edge 356 (which is provided with cutter 357), internal finger 358 and trailing edge 360. A plurality of cutters such as cutters 337 and 357 may be mounted on the leading edges of the mixing wings, or the leading edges could be provided with a cutting surface by providing a sharpened leading edge or portion thereof (not shown), or by providing abrasion-resistant hardfacing with carbide chunks imbedded therein (also not shown). The cutting blades of device 310 are each provided with a curved leading edge and are, oriented at a different angular position (clock position) relative to the axis of rotation of the body than the mixing wings.

Figure 9:
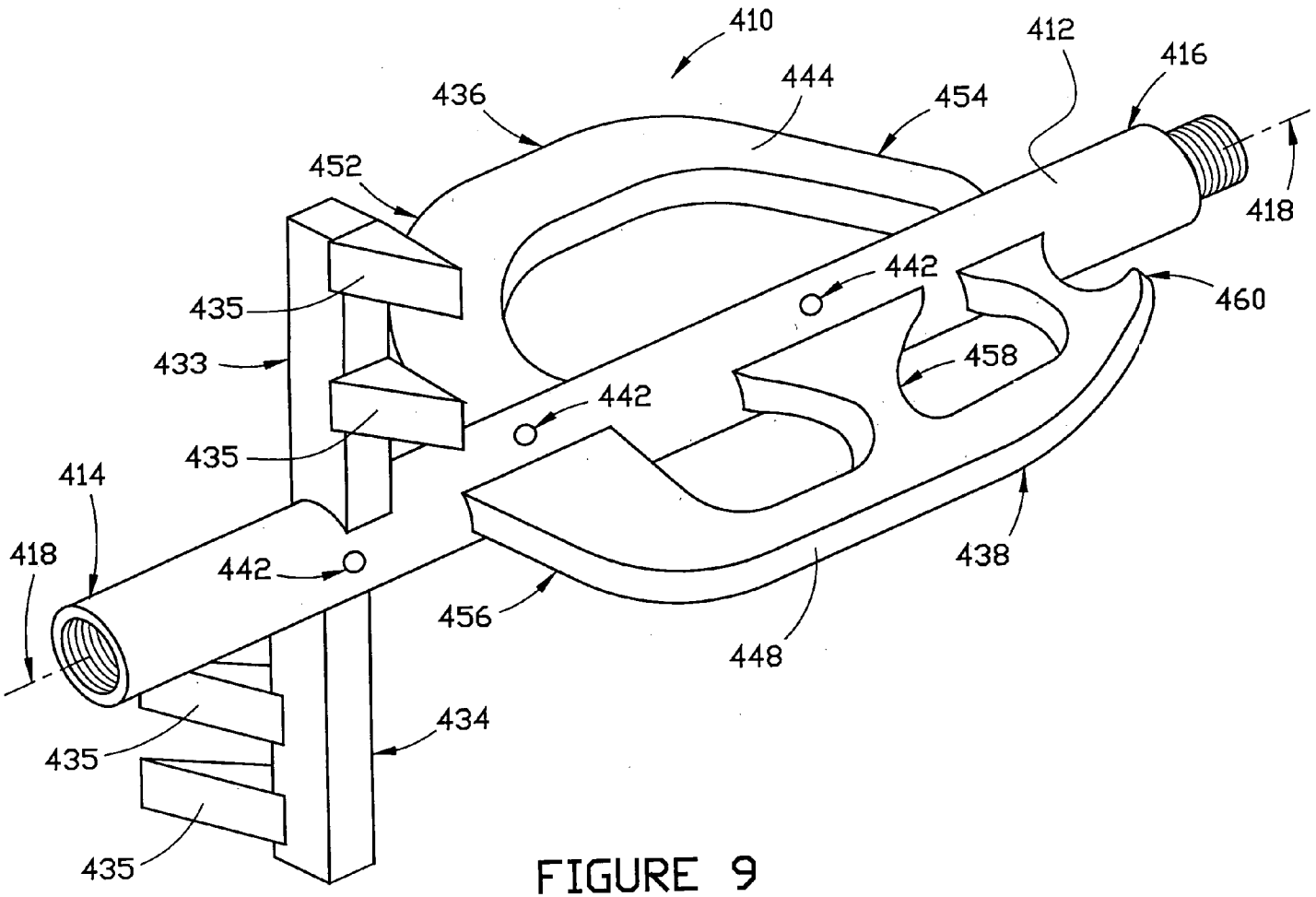
FIG. 9 is a perspective view of a fifth embodiment of the invention.

Another embodiment of the invention is illustrated in FIG. 9. As shown therein, device 410 includes elongate body 412 having a forward end 414, a rear end 416, and axis of rotation 418. Device 410 also includes a pair of cutting blades 433 and 434, which are attached to the body at or near its forward end. Each of the cutting blades is provided with a pair of cutter elements 435. Device 410 also includes a pair of mixing wings 436 and 438, each having a unique shape. Each of mixing wings 436 and 438 is attached to the body behind the cutting blades so that the axis of rotation of the body is within the plane spanned by the mixing wing. Preferably, these mixing wings are configured and located so that the center of mass of the device (not shown) is not on axis 418, the axis of rotation of the body. Elongate body 412 includes a passage for drilling fluid (not shown) and a plurality of orifices 442 that are in fluid communication with the passage through which drilling fluid may be dispensed from the body. Preferably, orifices 442 are arranged and configured so that drilling fluid passing through the passage is directed through the orifices in a direction that is generally perpendicular to axis 418.

Preferably, each of the mixing wings of device 410 has a unique mass and a unique surface area. It is also preferred that each of the mixing wings is formed by a band that is attached to the body behind the cutting blade or blades. Thus, mixing wing 436 of enlarging device 410 is formed by band 444, and mixing wing 438 is formed by band 448. Mixing wing 436 includes leading edge 452 and trailing edge 454. Mixing wing 438 includes leading edge 456, internal finger 458 and trailing edge 460. The cutting blades of device 410 are oriented at a different angular position (clock position) relative to the axis of rotation of the body than the mixing wings.

Figure 10:
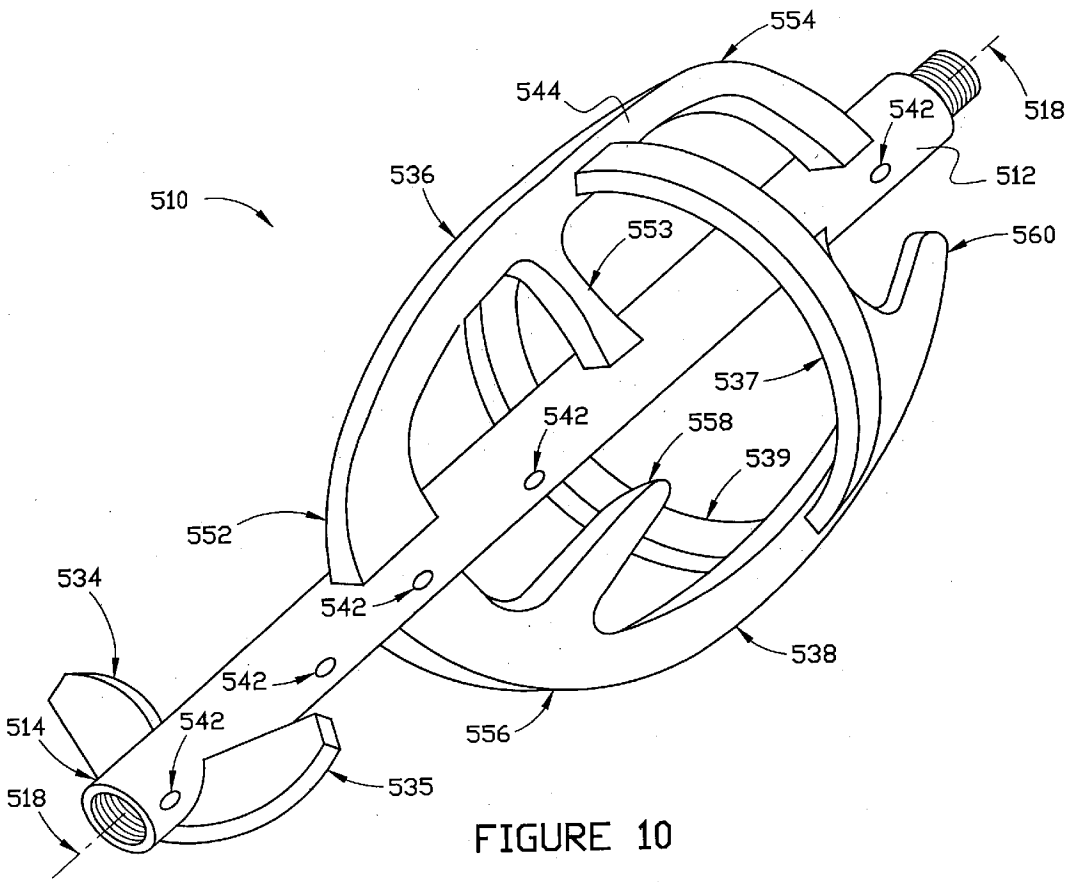
FIG. 10 is a perspective view of a sixth embodiment of the invention.

Another embodiment of the invention is illustrated in FIG. 10. As shown therein, device 510 includes elongate body 512 having a forward end 514, a rear end 516, and axis of rotation 518. Device 510 also includes a pair of cutting blades 534 and 535, which are attached to the body at or near its forward end. Device 510 also includes a pair of mixing wings 536 and 538, each of which has a unique shape. Each of mixing wings 536 and 538 is attached to the body behind the cutting blades so that the axis of rotation of the body is within the plane spanned by the mixing wing. Preferably, these mixing wings are configured and/or located so that the center of mass of the device (not shown) is not on axis 518, the axis of rotation of the body. Elongate body 512 includes a passage for drilling fluid (not shown) and a plurality of orifices 542 that are in fluid communication with the passage through which drilling fluid may be dispensed from the body. Preferably, orifices 542 are arranged and configured so that drilling fluid passing through the passage is directed through the orifices in a direction that is generally perpendicular to axis 518. Preferably, each of the mixing wings of device 510 has a unique mass and a unique surface area. It is also preferred that each of the mixing wings is formed by a band that is attached to the body behind the cutting blade or blades. Thus, mixing wing 536 of enlarging device 510 is formed by band 544, and mixing wing 538 is formed by band 548. Mixing wing 536 includes leading edge 552, an internal finger 553 and trailing edge 554. Mixing wing 538 includes leading edge 556, internal finger 558 and trailing edge 560. Each of mixing wings 536 and 538 has a unique shape, in part because each of the internal fingers 553 and 558 is generally oriented perpendicular to the other. Mixing wings 536 and 538 are supported by ring supports 537 and 539. The cutting blades of device 510 are each provided with a curved leading edge and are oriented at a different angular position (clock position) relative to the axis of rotation of the body than the mixing wings.

Figure 11:
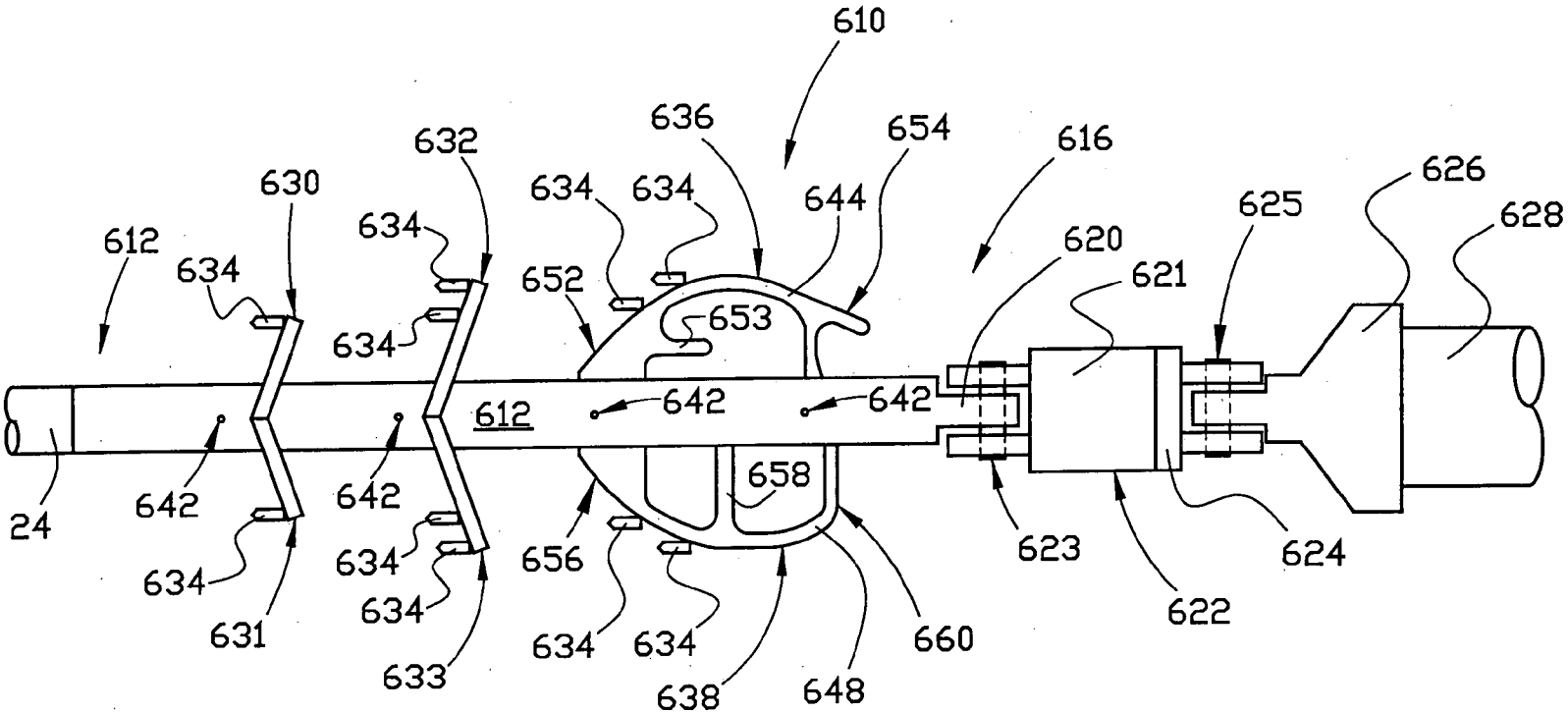
FIG. 11 is a side view of a seventh embodiment of the invention.

Another embodiment of the invention is illustrated in FIG. 11. As shown therein, device 610 includes elongate body 612 having a forward end 614, a rear end 616, and axis of rotation (not shown). The forward end of body 612 is adapted to be attached to a drill string such as drill string 24 of FIG. 3. Body 612 of device 610 is also provided with a pulling eye 620 at its rear end to which first end 621 of swivel 622 may be attached by pin 623. First end 621 and second end 624 of swivel 622 are adapted to rotate about the swivel axis (not shown) with respect to each other. Second end 624 is attached with pin 625 to coupler 626. The coupler may be attached to a pipe being installed, such as pipe 628. Device 610 also includes a plurality of cutting blades 630, 631, 632 and 633, each of which includes one or more cutting elements 634. The cutting blades are attached to the body at or near its forward end. Device 610 also includes a pair of mixing wings 636 and 638. Each of the mixing wings has a unique shape, and each is attached to the body behind the cutting blades so that the axis of rotation of the body is within the plane spanned by the mixing wing. Preferably, the mixing wings are configured and located so that the center of mass of the device (not shown) is not on the axis of rotation of the body (not shown). Elongate body 612 includes a passage for drilling fluid (not shown) and a plurality of orifices 642 that are in fluid communication with the passage through which drilling fluid may be dispensed from the body. Preferably, orifices 642 are arranged and configured so that drilling fluid passing through the passage is directed through the orifices in a direction that is generally perpendicular to the axis of rotation of body 612.

Preferably, each of the mixing wings of device 610 has a unique mass and a unique surface area. It is also preferred that each of the mixing wings is formed by a band that is attached to the body behind the cutting blade or blades. Thus, mixing wing 636 of enlarging device 610 is formed by band 644, and mixing wing 638 is formed by band 648. Mixing wing 636 includes leading edge 652, internal finger 653 and trailing edge 654. A portion of the leading edge of mixing wing 636 is provided with a cutting surface in the form of one or more cutter elements 634. Mixing wing 638 includes leading edge 656 (which is provided with one or more cutter elements 634), internal finger 658 and trailing edge 660. Each of mixing wings 636 and 638 has a unique shape, in part because each of the internal fingers 653 and 658 is generally oriented perpendicular to the other.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A device which is adapted for enlarging a bore, said device comprising:

(a) an elongate body having a forward end, a rear end and an axis of rotation, which body is adapted to be moved through the bore while being rotated about its axis;

(b) a cutting blade which is attached to the body at or near its forward end;

(c) a plurality of mixing wings, each of which:

(i) is attached to the body behind the cutting blade so that the axis of rotation of the body is within the plane spanned by the mixing wing;

(ii) has a unique shape.

2. The device of claim 1 wherein each of the mixing wings has a unique mass.

3. The device of claim 1 wherein:

(a) said device has a center of mass; and (b) said wings are configured and located so that the center of mass of the device is not on the axis of rotation of the body.

4. The device of claim 1 which includes two mixing wings that are located on generally opposite sides of the elongate body.

5. The device of claim 1 in which a mixing wing includes a leading edge and a trailing edge, and in which at least a portion of the leading edge is provided with a cutting surface.

6. The device of claim 1 in which a mixing wing includes a leading edge that is swept back at a gradually increasing distance from the body in a configuration that is generally convex, and a trailing edge that is curved towards the body.

7. The device of claim 1 in the elongate body includes a passage for drilling fluid and a plurality of orifices in fluid communication with the passage, which orifices are arranged and configured so that drilling fluid passing through the passage is directed through the orifices in a direction that is generally perpendicular to the axis.

8. The device of claim 1 wherein each mixing wing includes an open area within the area spanned by the wing.

9. The device of claim 8 wherein each mixing wing includes an internal finger that is unique.

10. The device of claim 8 wherein the area occupied by each mixing wing comprises no more than about 40% of the area spanned by such wing.

11. The device of claim 10 wherein the area occupied by each mixing wing comprises no more than about 15% of the cross-sectional area of the enlarged bore.

12. The device of claim 1 which includes a first pair of cutting blades that are:

(a) attached to the elongate body at or near its forward end and located on generally opposite sides of the body;

(b) oriented at an angle of less than 90° with respect to the axis of rotation of the body.

13. The device of claim 12 in which each of the cutting blades has a leading edge that is curved.

14. The device of claim 12 which includes a second pair of cutting blades that are attached to the elongate body and located on generally opposite sides of the body behind the first pair of cutting blades.

15. A device which is adapted for enlarging a bore having a centerline, said device comprising:

(a) an elongate body having a forward end, a rear end and an axis of rotation, which body is adapted for being moved through the bore while being rotated about its axis;

(b) a cutting blade which is attached to the body at or near its forward end;

(c) a plurality of mixing wings, each of which is attached to the body behind the cutting blade so that the axis of rotation of the body is within the plane spanned by the mixing wing;

wherein said wings are configured and located so that the axis of rotation of the body will move with respect to the centerline as the body is rotated and moved through the bore.

16. A device for enlarging a bore, said device comprising:

(a) an elongate body having a forward end, a rear end and an axis of rotation, which body is adapted for being moved through the bore while being rotated about its axis;

(b) a pair of cutting blades which are attached to the body at or near its forward end;

(c) a pair of mixing wings that are located on generally opposite sides of the elongate body, each of which has a unique shape, and each of which is formed by a band that is attached to the body behind the cutting blade so that the axis of rotation of the body is within the plane spanned by the mixing wing.

17. The device of claim 16 wherein the area occupied by the band of each mixing wing comprises:

(a) no more than about 40% of the area spanned by such wing;

(b) no more than about 15% of the cross-sectional area of the enlarged bore.

18. The device of claim 16 wherein each of the mixing wings has a unique surface area.

19. The device of claim 16 wherein each of the mixing wings has an internal finger that is generally perpendicular to an internal finger of the other.

20. A device which is adapted for enlarging a bore, said device comprising:

(a) an elongate body having a forward end, a rear end and an axis of rotation, which body is adapted to be moved through the bore while being rotated about its axis;

(b) a first pair of cutting blades which are:

(i) attached to the body at or near its forward end;

(ii) located on generally opposite sides of the elongate body;

(iii) oriented at an angle of less than 90° with respect to the axis of rotation of the body;

(c) a plurality of mixing wings, each of which:

(i) is attached to the body behind the cutting blade so that the axis of rotation of the body is within the plane spanned by the mixing wing;

(ii) has a unique shape;

wherein, the cutting blades are oriented at different angular positions, with respect to the axis of rotation of the body, than the mixing wings.

21. A device which is adapted for enlarging a bore, said device comprising:

(a) an elongate body having a forward end, a rear end and an axis of rotation, which body is adapted to be moved through the bore while being rotated about its axis;

(b) a cutting blade which is attached to the body at or near its forward end;

(c) a first mixing wing that is attached to the body behind the cutting blade so that the axis of rotation of the body is within the plane spanned by the mixing wing, said first mixing wing having a trailing edge having a first shape;

(d) a second mixing wing that is attached to the body behind the cutting blade so that the axis of rotation of the body is within the plane spanned by the mixing wing, said second mixing wing having a trailing edge having a second shape, wherein said second shape is different from the first shape.

* * * * *

UNITED STATES PATENT AND TRADEMARK OFFICE

CERTIFICATE OF CORRECTION

PATENT NO. : 6,929,078 B1
DATED : August 16, 2005
INVENTOR(S) : Guy P. Randall

It is certified that error appears in the above-identified patent and that said Letters Patent is hereby corrected as shown below:

Column 10,
Line 58, insert -- which -- after the word “in” and before the word “the”.

Signed and Sealed this

Eleventh Day of October, 2005

JON W. DUDAS
*Director of the United States Patent and Trademark Office*